US007544068B2

(12) United States Patent
Glaab, III et al.

(10) Patent No.: US 7,544,068 B2
(45) Date of Patent: Jun. 9, 2009

(54) FULLY SHIELDED BACKSHELL FOR ELECTRICAL CONNECTOR

(75) Inventors: George Henry Glaab, III, Newbury Park, CA (US); Rodney Noble, Lancaster, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 0 days.

(21) Appl. No.: 11/741,197

(22) Filed: Apr. 27, 2007

(65) Prior Publication Data

US 2008/0268709 A1 Oct. 30, 2008

(51) Int. Cl.
*H01R 4/66* (2006.01)

(52) U.S. Cl. ..... 439/97; 439/607

(58) Field of Classification Search ..... 439/97, 439/607, 609, 610, 95, 106
See application file for complete search history.

(56) References Cited

U.S. PATENT DOCUMENTS

| | | | | | |
|---|---|---|---|---|---|
| 4,025,145 | A * | 5/1977 | Shaffer et al. | 439/610 |
| 4,111,513 | A | 9/1978 | Thurston et al. | |
| 4,272,148 | A * | 6/1981 | Knack, Jr. | 439/455 |
| 4,291,930 | A * | 9/1981 | Landgreen | 439/97 |
| 4,671,598 | A | 6/1987 | Keehne | |
| 4,963,103 | A | 10/1990 | Fink et al. | |
| 5,123,860 | A | 6/1992 | Kamei et al. | |
| 5,145,412 | A * | 9/1992 | Tan et al. | 439/620.03 |
| 5,186,635 | A | 2/1993 | Pechulis et al. | |
| 5,308,264 | A * | 5/1994 | Perretta et al. | 439/607 |
| 5,342,203 | A | 8/1994 | Perretta et al. | |
| 5,401,177 | A * | 3/1995 | Dutton et al. | 439/98 |
| 5,474,473 | A | 12/1995 | Perretta et al. | |
| 5,831,815 | A * | 11/1998 | Miller et al. | 361/679 |
| 6,309,258 | B1 * | 10/2001 | Measley | 439/738 |
| 6,354,879 | B1 | 3/2002 | Plehaty | |
| 6,439,929 | B1 * | 8/2002 | Jenets | 439/610 |
| 6,568,964 | B2 * | 5/2003 | D'Addario | 439/675 |
| 6,705,894 | B1 | 3/2004 | Comerci et al. | |
| 6,729,912 | B2 * | 5/2004 | D'Addario | 439/675 |
| 7,014,480 | B1 * | 3/2006 | Weidner et al. | 439/95 |

* cited by examiner

*Primary Examiner*—James Harvey
(74) *Attorney, Agent, or Firm*—Carlson, Gaskey & Olds

(57) ABSTRACT

A connector assembly includes a connector mounted within a backshell and a biasing member that forces the connector into contact with a surface of the backshell to improve ground shield junction performance. The biasing member extends into an internal space defined by the backshell and exerts a biasing force to reduce resistance between the connector and the backshell. The reduced resistance provided by the biasing member improves ground shield junction performance against electromechanical interference (EMI) and radio frequency interference (RFI).

16 Claims, 1 Drawing Sheet

FULLY SHIELDED BACKSHELL FOR ELECTRICAL CONNECTOR

This invention was made with government support under Contract No.: N00024-03-C-6111 awarded by the Department of the Navy. The government therefore may have certain rights in this invention.

BACKGROUND OF THE INVENTION

This invention generally relates to an electrical connector including shielding against interfering electrical signals. More particularly, this invention relates to a backshell providing improved continuity and shielding for an electrical connector.

An electrical connector is a device for providing a secure electrical connection between electrical devices and controllers. In many applications, the connector transmits electrical communications that are utilized to control or relay information. In such applications it is desirable to prevent outside interference from disrupting the electrical communication. Outside interference is present in many forms dependent on the environment in which the electrical conductor is installed.

In many applications shielding is provided that surrounds the electrical conductor to substantially prevent interference from penetrating the electrical conductor. Such shielding provides a ground path that dissipates and prevents outside electrical signals from interfering with the electrical communication through the electrical conductor. The connector is supported in a backshell that is in turn electrically connected to the shielding. The interface between the backshell and the connector provides a ground path necessary to prevent interferences at the connector.

Specifications for many applications are becoming increasingly stringent and include requirements for very low resistance between the backshell and the shielding. Typical mounting of the connector into the backshell does not provide the desired low resistance.

Accordingly, it is desirable to design and develop a device and method for providing the desired shielded connection between the connector body and the backshell.

SUMMARY OF THE INVENTION

A disclosed example connector assembly includes a connector mounted within a backshell and a biasing member that forces the connector into contact with a surface of the backshell to improve ground shield junction performance.

The example connector assembly includes a connector mounted within the backshell. A shield is attached to the backshell and secured in place by a strap. The shield surrounds wires and other electrical conduits against undesired electromechanical and radio frequency signals that could interfere with desired electrical communication. The example biasing member extends into an internal space defined by the backshell and exerts a biasing force to reduce resistance between the connector and the backshell. The reduced resistance provided by the biasing member improves ground shield junction performance against electromechanical interference (EMI) and radio frequency interference (RFI).

Accordingly, the example connector assembly provides the desired EMI and RFI shielding by generating a large surface area of contact at a desired pressure with biasing members mounted within the backshell. The positive force provides uniform and dependable EMI-RFI shielding performance.

These and other features of the present invention can be best understood from the following specification and drawings, the following of which is a brief description.

DETAILED DESCRIPTION OF THE PREFERRED EMBODIMENT

Figure 1:
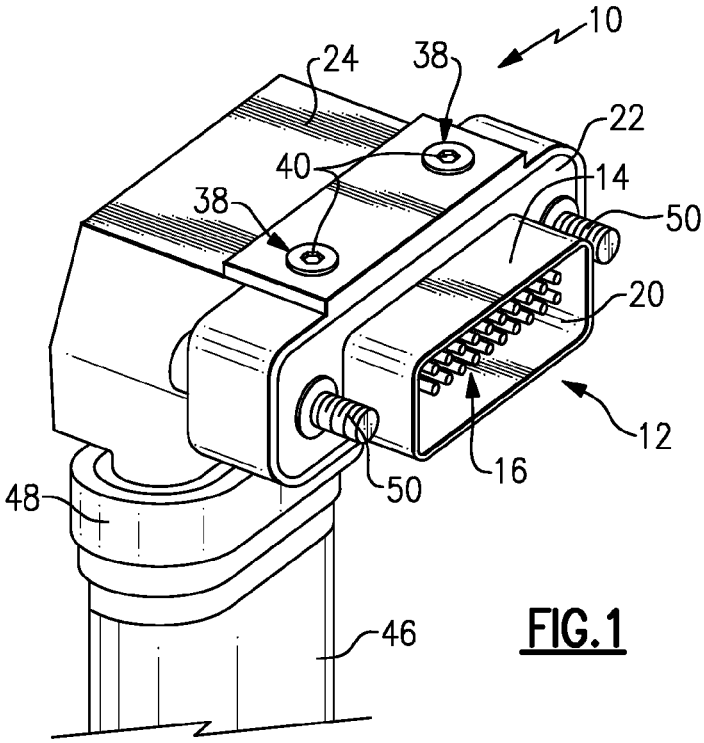
FIG. 1 is a perspective view of an example connector assembly with backshell.

Referring to FIG. 1, an example connector assembly 10 includes an electrical connector 12 mounted within a backshell 24. The connector 12 includes a plurality of pins 16 for mating with a mating electrical connector 15 (FIG. 2) either on another cable or mounted within a housing. The pins 16 are disposed within a D-shaped mating opening 20 that protects and aligns the pins 16 with a mating electrical connector.

The connector 12 includes a flange 22 that seats against a front opening 28 (FIG. 2) of the backshell 24. The backshell 24 also includes fasteners 50 for securely mounting the connector assembly 10. A shield 46 is attached to the backshell 24 and secured in place by a strap 48. The shield 46 surrounds wires and other electrical conduits disposed within against undesired electromechanical and radio frequency signals that could interfere with desired electrical communication.

The backshell 24 includes threaded fasteners 40 that are received within threaded openings 38 and extend into an internal space defined by the backshell 24. The threaded fasteners engage a surface of the connector 12 and exert a biasing force to improve continuity between the connector body 14 and the backshell 24.

Figure 2:
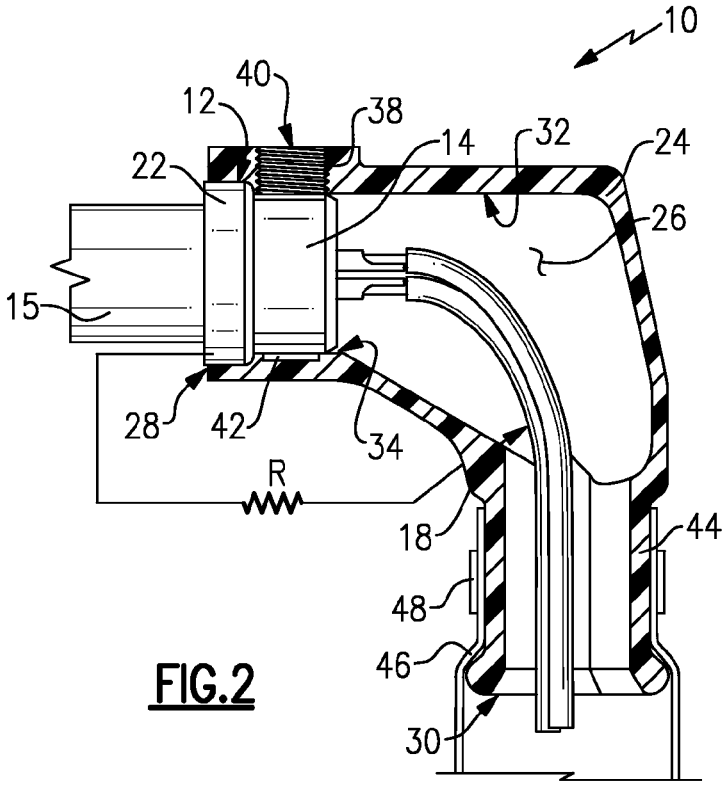
FIG. 2 is a cross-sectional view of the example connector assembly.

Referring to FIG. 2, the backshell 24 defines a cavity 26 that includes a top internal surface 32 and a bottom internal surface 34. The connector body 14 extends into the cavity 26 through a front opening 28 of the cavity 26. Wires 18 that terminate at the connector 12 exit the cavity 26 through a rear opening 30. The wires 18 exit the backshell 24 and extend into the shield 46. The shield 46 is crimped to a shoulder 44 of the backshell by the strap 48. The connection of the shield 46 to the backshell 24 provides a secure termination of the shield 46 and also provides a desired electrical contact between the shield and the backshell 24.

Performance specifications for the example connector require an electromechanical interference (EMI) and radio frequency interference (RFI) ground shield between the backshell 24 and the connector body 12. Accordingly, the ground path between the connector body 14 and the backshell 24 must be of very little resistance to provide the desired ground path performance.

The threaded members 40 extend through the backshell 24 and into the cavity 26 to engage the connector body 14. The threaded members 40 are installed to press against the connector body 14 and produce a pressure between a bottom surface 34 of the backshell cavity 26 and the connector body 14 at an interface area indicated at 42. The interface area 42 increases conductivity between the backshell 24 and the connector body 14 to reduce the amount of any resistance. An example ground path resistance between the backshell 24 and the connector body is less than 2.5 milliohms. This meets or exceeds the desired ground shield performance requirements.

The example interface area 42 is provided by the force exerted downwardly by the threaded members 40. The example threaded members 40 are set screws received within the corresponding threaded opening 38. However, other biasing devices or fasteners are also within the contemplation of this invention including, machine screws, interference members or other know biasing structures that provide for the exertion of a biasing force that produces the desired contact between a surface of the connector body 14 and the backshell 24.

The example connector assembly 10 provides the desired EMI and RFI shielding by generating a large surface area of contact at a desired pressure with biasing members mounted within the backshell 24. The positive force provided by the biasing members 40 maintains the desired contact between the backshell 24 and the connector body 14 that provides uniform and dependable EMI-RFI shielding performance.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A connector assembly comprising:

a backshell defining a cavity, the backshell including a substantially flat top surface and the cavity including a lower surface;

a connector including a connector body disposed within the cavity, and a means for generating a desired pressure between the connector body and an inner surface of the cavity within the backshell to provide a desired electrical continuity between the backshell and the connector body, wherein the means for generating a desired pressure is disposed in the top surface and extends through the backshell and against the connector body to force the connector body against the lower surface of the cavity.

2. A connector assembly comprising:

a backshell defining a cavity, wherein the backshell includes a substantially flat top surface and the cavity includes a lower surface;

a connector including a connector body disposed within the cavity, and a means for generating a desired pressure between the connector body and the backshell to provide a desired electrical continuity between the backshell and the connector body , wherein the means for generating a desired pressure comprises a threaded member received within a threaded opening within the backshell, where the threaded member extends through the top surface of the backshell and against the connector body disposed within the cavity to force the connector body against the lower surface of the cavity.

3. The assembly as recited in claim 2, including two threaded members disposed in corresponding threaded openings within the backshell.

4. The assembly as recited in claim 1, including a shield electrically connected to the backshell.

5. The assembly as recited in claim 1, wherein the backshell includes at least one fastener for attaching the connector assembly to a mating electrical coupling.

6. The assembly as recited in claim 1, wherein a resistance between the connector body and the backshell is less than or equal to about 2.5 milliohms.

7. The assembly as recited in claim 1, wherein the cavity includes a front opening for the connector body and a back opening for a plurality of electrical conduits electrically attached to the connector.

8. A method of grounding a connector to a cable shield comprising the steps of:

a) electrically connecting a shield to a backshell housing;

b) disposing a connector within the backshell housing that includes a substantially flat top surface; and c) biasing the connector against an inner lower surface of the backshell housing with a biasing member mounted within the top surface of within the top surface of the backshell housing and pressing against the connector.

9. A shielded connector assembly comprising:

a backshell defining a cavity having a lower surface, front opening and a rear opening, the backshell including a substantially flat top surface;

a shield electrically connected to the backshell at the rear opening;

a connector assembly mounted into the front opening of the cavity that includes a connector body supporting a plurality of mating conductors; and a biasing member disposed within the top surface of the backshell and against the connector body for biasing the connector body into electrical contact with the lower surface of the cavity within the backshell.

10. The assembly as recited in claim 9, wherein the connector body includes a flange abutting a front surface of the backshell adjacent the front opening.

11. A shielded connector assembly comprising:

a backshell defining a cavity having a front opening and a rear opening, the backshell including a substantially flat top surface;

a shield electrically connected to the backshell at the rear opening;

a connector assembly mounted into the front opening of the cavity that includes a connector body supporting a plurality of mating conductors; and a biasing member disposed within the backshell for biasing the connector body into electrical contact with a surface of the cavity within the backshell, wherein the biasing member comprises at least two threaded members received within a threaded opening disposed within the top surface of the backshell that extend into the cavity and into contact with the connector body for generating a pressure between the connector body and the backshell.

12. The assembly as recited in claim 11, wherein the generated pressure between the connector body and the backshell is of a magnitude to provide an electrical resistance between the backshell and the connector body less than or equal to about 2.5 milliohms.

13. The assembly as recited in claim 11, wherein the cavity includes a bottom surface, where the threaded members are disposed in the top surface and press the connector body downward against the bottom surface.

14. The assembly as recited in claim 9, wherein the backshell supports mounting fasteners for attaching the connector assembly to a mating electrical receptacle.

15. The method as recited in claim 8, wherein said step c, comprises exerting a biasing force on a first surface of the connector such that a second surface of the connector is biased into contact with the inner surface of the backshell housing.

16. The method as recited in claim 15, wherein the biasing force on the first surface of the connector generates a pressure over an interface area between the inner surface of the backshell housing and the connector.

* * * * *

UNITED STATES PATENT AND TRADEMARK OFFICE

CERTIFICATE OF CORRECTION

PATENT NO. : 7,544,068 B2
APPLICATION NO. : 11/741197
DATED : June 9, 2009
INVENTOR(S) : Glaab, III et al.

It is certified that error appears in the above-identified patent and that said Letters Patent is hereby corrected as shown below:

Claim 8, Column 4, Line 8: Deleted second "within the top surface of"

Signed and Sealed this

Eighteenth Day of August, 2009

David J. Kappos

David J. Kappos
*Director of the United States Patent and Trademark Office*